US011391473B2

(12) United States Patent
Shimomugi et al.

(10) Patent No.: US 11,391,473 B2
(45) Date of Patent: Jul. 19, 2022

(54) OUTDOOR UNIT AND AIR CONDITIONER

(71) Applicant: Mitsubishi Electric Corporation, Tokyo (JP)

(72) Inventors: Takuya Shimomugi, Tokyo (JP); Keisuke Mori, Tokyo (JP); Koichi Arisawa, Tokyo (JP); Satoru Ichiki, Tokyo (JP); Keisuke Uemura, Tokyo (JP); Kenji Iwazaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 17/264,555

(22) PCT Filed: Aug. 29, 2018

(86) PCT No.: PCT/JP2018/032002
§ 371 (c)(1),
(2) Date: Jan. 29, 2021

(87) PCT Pub. No.: WO2020/044474
PCT Pub. Date: Mar. 5, 2020

(65) Prior Publication Data

US 2021/0317999 A1 Oct. 14, 2021

(51) Int. Cl.
*F24F 1/22* (2011.01)
*F24F 1/24* (2011.01)
(Continued)

(52) U.S. Cl.
CPC ..... *F24F 1/22* (2013.01); *F24F 1/24* (2013.01); *F24F 1/48* (2013.01); *F24F 13/20* (2013.01)

(58) Field of Classification Search
CPC ..... F24F 1/22; F24F 1/24; F24F 1/48; F24F 13/20
(Continued)

(56) References Cited

U.S. PATENT DOCUMENTS 5,597,035 A 1/1997 Smith et al.
7,760,506 B1 * 7/2010 Wang ..... H05K 7/20727 361/679.48
2015/0009626 A1 * 1/2015 Lan ..... F24F 1/0073 361/714

FOREIGN PATENT DOCUMENTS

JP H02-052491 A 4/1990
JP H02-052491 U 4/1990
(Continued)

OTHER PUBLICATIONS

Office Action dated Oct. 9, 2021, issued in corresponding CN Patent Application No. 201880096787.2 (and English Machine Translation).
(Continued)

*Primary Examiner* — Steve S Tanenbaum
(74) *Attorney, Agent, or Firm* — Posz Law Group, PLC

(57) ABSTRACT

An outdoor unit includes a housing that includes a front panel having an outlet for an airflow, a back panel facing the front panel, a left side panel, a right side panel facing the left side panel, a bottom panel, and a top panel facing the bottom panel. The outdoor unit further includes a control substrate that is provided in the housing and provided with an electric component, an electric component box in which the control substrate is provided, and a heat dissipator that is provided between the top panel and the electric component box and dissipates heat generated by the electric component. A second region surrounded by the heat dissipator, the back panel, the front panel, the electric component box, and the top panel is formed on a windward side of the heat dissipator.

8 Claims, 6 Drawing Sheets

(51) Int. Cl.
*F24F 1/48* (2011.01)
*F24F 13/20* (2006.01)

(58) Field of Classification Search
USPC ..... 62/259.2
See application file for complete search history.

(56) References Cited

FOREIGN PATENT DOCUMENTS

| | | | | |
|---|---|---|---|---|
| JP | H05-029504 | A | | 2/1993 |
| JP | H06-035835 | U | | 5/1994 |
| JP | 2003-229520 | A | | 8/2003 |
| JP | 2009-299907 | A | | 12/2009 |
| JP | 2009299907 | A | * | 12/2009 |
| JP | 2013-064539 | A | | 4/2013 |
| JP | 2013-137132 | A | | 7/2013 |

OTHER PUBLICATIONS

Office Action dated Oct. 19, 2021, issued in corresponding JP Patent Application No. 2020-539932 (and English Machine Translation).
Office Action dated May 25, 2021, issued in corresponding JP Patent Application No. 2020-539932 (and English Machine Translation).
International Search Report of the International Searching Authority dated Oct. 30, 2018 for the corresponding International application No. PCT/JP2018/032002 (and English translation).

* cited by examiner

OUTDOOR UNIT AND AIR CONDITIONER

CROSS REFERENCE TO RELATED APPLICATION

This application is a U.S. national stage application of International Application No. PCT/JP2018/032002 filed on Aug. 29, 2018, the contents of which are incorporated herein by reference.

TECHNICAL FIELD

The present invention relates to an outdoor unit and an air conditioner, the outdoor unit including a heat dissipator.

BACKGROUND

An outdoor unit disclosed in Patent Literature 1 includes: a housing with an outlet formed on a front panel; a heat exchanger, a compressor, and a blower provided in the housing; a control substrate provided in the housing and controlling the operation of the compressor and the blower; an electric component provided on the control substrate; and a heat dissipator for dissipating heat generated by the electric component. The outdoor unit further includes a partition board that partitions the space in the housing into a blower chamber and a compressor chamber, the blower chamber being a space where the blower is arranged, and the compressor chamber being a space where the compressor is arranged. The heat dissipator includes a base thermally connected to the electric component, and a plurality of fins provided on the base. An air guide is provided on the side of tips of the plurality of fins, and the space surrounded by the base, the plurality of fins, and the air guide forms an air passage. According to the outdoor unit disclosed in Patent Literature 1, even when the heat dissipator is provided near the periphery of a blower fan having a relatively small amount of ventilation, the entire heat dissipator is cooled efficiently by allowing air to flow through the air passage formed in the heat dissipator.

CITATION LIST

Patent Literature

Patent Literature 1: Japanese Patent Application Laid-open No. 2009-299907

However, when a bell mouth is provided around the outlet of the housing of the outdoor unit disclosed in Patent Literature 1, a closed space surrounded by an outer peripheral surface of the bell mouth, an inner surface of the front panel, and the partition board is formed in the housing. The bell mouth is an annular member that projects from an annular wall surface forming the outlet into the housing so as to reduce a pressure loss when the air having passed through the heat exchanger and flowed into an blower chamber is discharged to the outside of the blower chamber through the outlet. In this closed space, the pressure tends to be high because the air flow is more stagnant therein than in the space outside the closed space. Therefore, when leeward end surfaces of the fins lie in the closed space, the air having entered the air passage formed between the adjacent fins from windward end surfaces of the fins flows toward the tips of the fins, that is, ends of the fins on the side opposite to the side of the base, before reaching the leeward end surfaces of the fins. Such a change in the direction of flow of the air having entered the air passage causes a decrease in the velocity of flow of the air at the leeward end surfaces of the fins, so that the cooling capacity of the heat dissipator cannot be sufficiently achieved.

The present invention has been made in view of the above, and an object of the present invention is to provide an outdoor unit in which the cooling capacity of a heat dissipator can be improved even when a bell mouth is provided in a housing.

SUMMARY

An outdoor unit according to an aspect of the present invention includes a housing that includes a front panel having an outlet for an airflow, a back panel facing the front panel, a left side panel, a right side panel facing the left side panel, a bottom panel, and a top panel facing the bottom panel. The outdoor unit further includes a control substrate that is provided in the housing and provided with an electric component, an electric component box in which the control substrate is provided, and a heat dissipator that is provided between the top panel and the electric component box and dissipates heat generated by the electric component. A region surrounded by the heat dissipator, the back panel, the front panel, the electric component box, and the top panel is formed on a windward side of the heat dissipator.

The outdoor unit according to the present invention has an effect that the cooling capacity of the heat dissipator can be improved even when the bell mouth is provided in the housing.

DETAILED DESCRIPTION

An outdoor unit and an air conditioner according to embodiments of the present invention will now be described in detail with reference to the drawings. Note that the present invention is not limited to the embodiments.

First Embodiment

Figure 1:
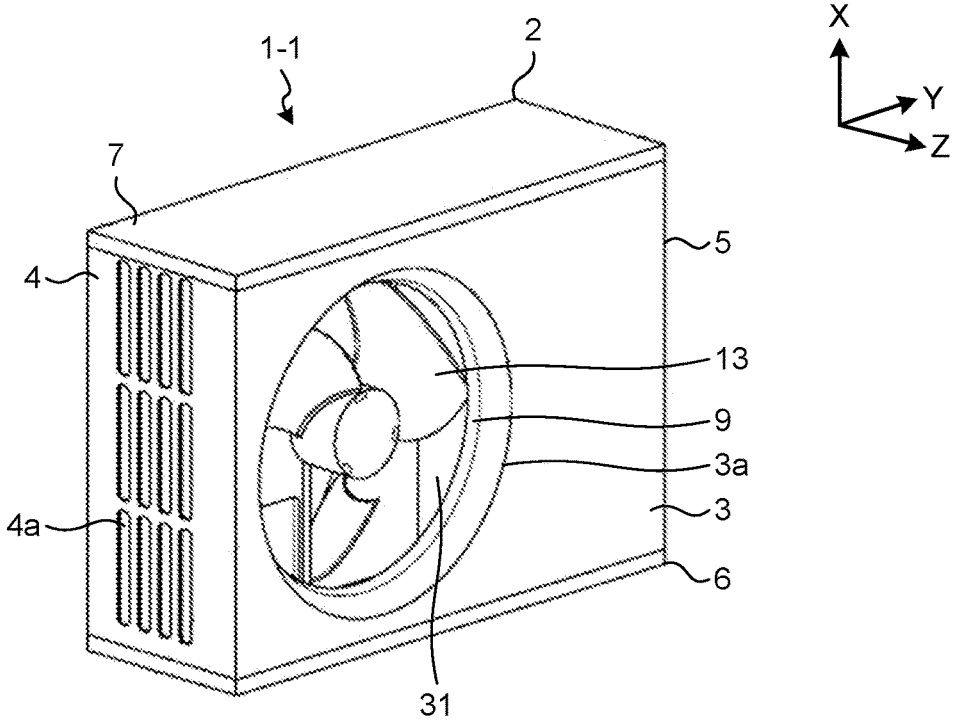
FIG. 1 is an external view of an outdoor unit according to a first embodiment of the present invention.
Figure 2:
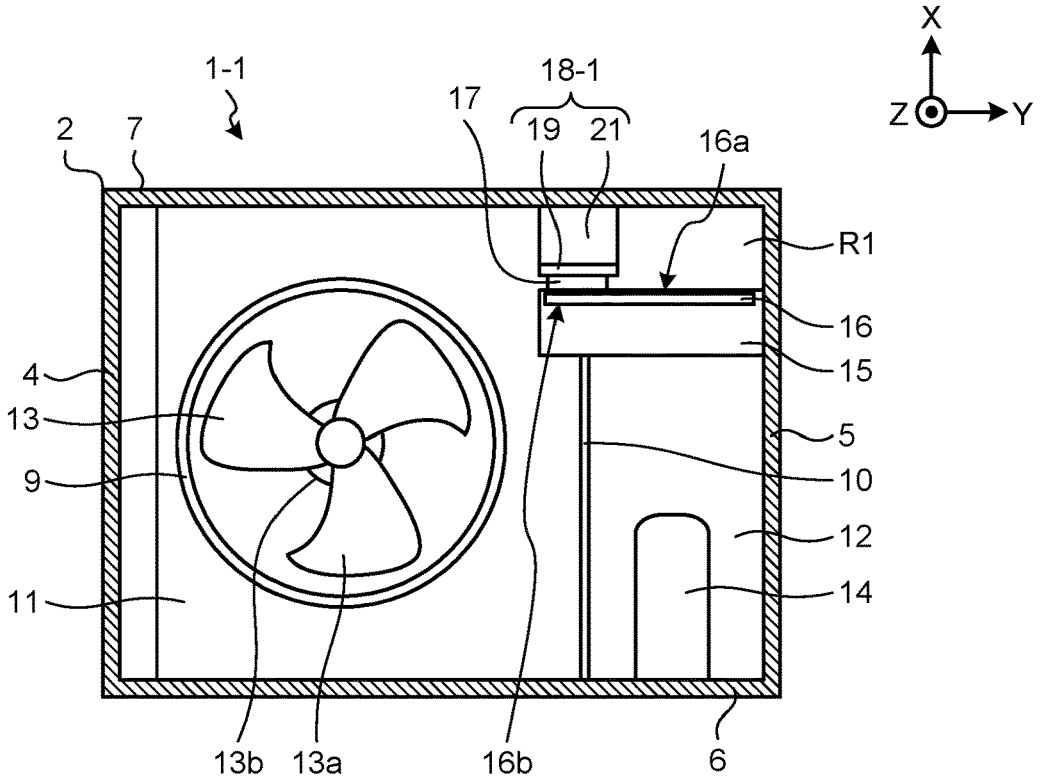
FIG. 2 is an internal view of the outdoor unit illustrated in FIG. 1 as viewed from the front.
Figure 3:
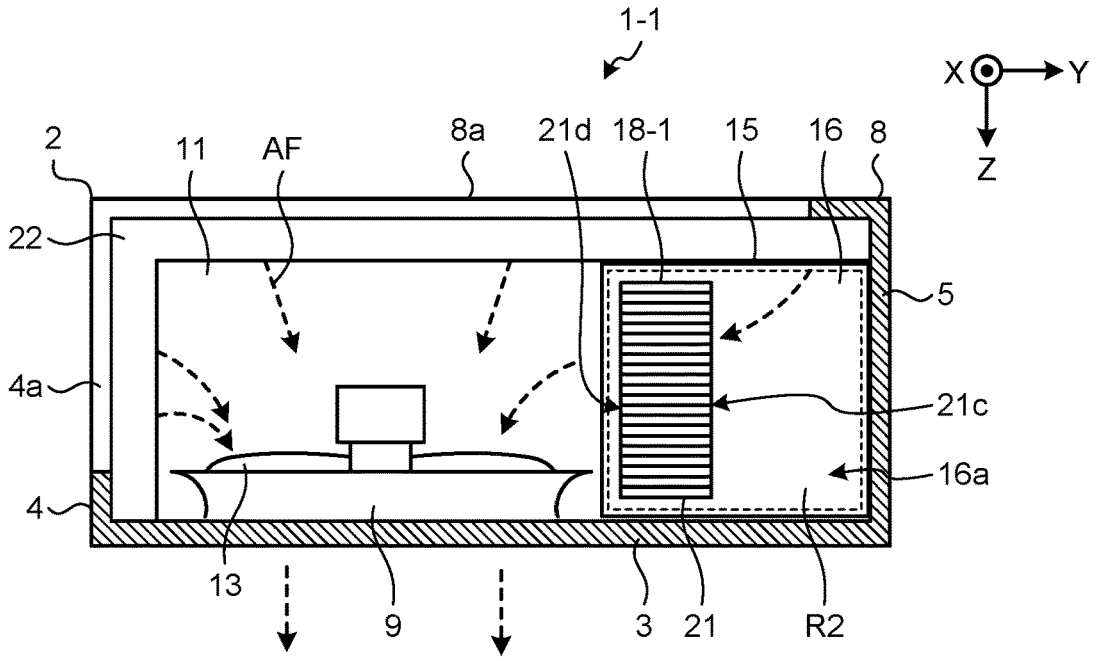
FIG. 3 is an internal view of the outdoor unit illustrated in FIG. 1 as viewed from above.

First, an overview of the configuration of an outdoor unit 1-1 according to a first embodiment of the present invention will be described with reference to FIGS. 1 to 3. FIG. 1 is an external view of the outdoor unit according to the first embodiment of the present invention. FIG. 2 is an internal view of the outdoor unit illustrated in FIG. 1 as viewed from the front. FIG. 3 is an internal view of the outdoor unit illustrated in FIG. 1 as viewed from above. The outdoor unit 1-1 is an outdoor unit of an air conditioner. The air conditioner uses a refrigerant circulating between the outdoor unit 1-1 and an indoor unit placed in a room to transfer heat between the indoor air and the outdoor air, and perform air conditioning of the room. The outdoor unit 1-1 includes a housing 2 that forms an outer shell of the outdoor unit 1-1. The outdoor unit 1-1 further includes a blower 13, a bell mouth 9, a compressor 14, a partition board 10, a control substrate 16, a heat dissipator 18-1, an electric component box 15, and a heat exchanger 22 that are provided inside the housing 2. FIGS. 1 to 3 use left-handed XYZ coordinates to define a direction along the vertical width of the outdoor unit 1-1 as an X axis direction, a direction along the horizontal width of the outdoor unit 1-1 as a Y axis direction, and a direction along the depth of the outdoor unit 1-1 as a Z axis direction. The axial directions similar to the above are also applied to FIG. 4 and the following drawings.

The housing 2 includes a front panel 3 that forms a front surface of the housing 2, a back panel 8 that faces the front panel 3 and forms a back surface of the housing 2, a left side panel 4 that forms a side surface on the left side of the housing 2 when the housing 2 is viewed from the front, a right side panel 5 that faces the left side panel 4, a bottom panel 6 that forms a bottom surface of the housing 2, and a top panel 7 that faces the bottom panel 6. Note that the front panel 3 and the left side panel 4 may be formed by one component.

An inlet 4*a* is formed on the left side panel 4. An inlet 8*a* is formed on the back panel 8. The inlet 4*a* and the inlet 8*a* are for taking air from the outside of the housing 2 into the housing 2.

An outlet 31 of a circular shape is formed on the front panel 3. The outlet 31 is an opening for discharging the air taken into the housing 2 to the outside of the housing 2. The bell mouth 9 is provided on a wall surface 3*a* having an annular shape and forming the outlet 31. The bell mouth 9 is an annular member projecting from the wall surface 3*a* into the housing 2.

Inside the housing 2, the blower 13 is arranged within a region that is obtained by projecting an inner edge of the bell mouth 9 from the front panel 3 of the housing 2 toward the back panel 8 thereof. The blower 13 includes an impeller 13*a* and a motor 13*b* that is a power source for the impeller 13*a*. When the motor 13*b* of the blower 13 is driven to cause the impeller 13*a* of the blower 13 to rotate, air is taken into a blower chamber 11 of the housing 2 through the inlets 4*a* and 8*a*. The air taken into the blower chamber 11 is discharged to the outside of the housing 2 through the outlet 31. In FIG. 3, a broken arrow indicates an airflow AF generated inside the housing 2 due to the rotation of the blower 13. The airflow AF is a flow of the air taken into the blower chamber 11 of the housing 2 from the outside of the housing 2.

The partition board 10 is a member that partitions the space in the housing 2 into the blower chamber 11 and a compressor chamber 12, the blower chamber 11 being a space where the blower 13 is arranged, and the compressor chamber 12 being a space where the compressor 14 is arranged. The blower chamber 11 is the space surrounded by the front panel 3, the left side panel 4, the bottom panel 6, the top panel 7, the back panel 8, and the partition board 10. The compressor chamber 12 is the space surrounded by the front panel 3, the right side panel 5, the bottom panel 6, the electric component box 15, the back panel 8, and the partition board 10. When the outdoor unit 1-1 is viewed from the front, for example, the partition board 10 extends from the bottom panel 6 toward the top panel 7 and comes into contact with a lower surface of the electric component box 15 before reaching the top panel 7.

The compressor chamber 12 is the space surrounded by the partition board 10 and the right side panel 5. The compressor chamber 12 is provided with the compressor 14 for compressing the refrigerant. The compressor 14 is connected to a plurality of pipes (not shown) included in the heat exchanger 22, and the refrigerant compressed by the compressor 14 is sent to the pipes. When air passes through the heat exchanger 22, heat exchange occurs between the refrigerant flowing through the pipes and the heat exchanger 22.

The heat exchanger 22 is provided inside the housing 2 so as to cover the inlets 4*a* and 8*a*. The heat exchanger 22 is provided in the blower chamber 11 and faces the inside of each of the back panel 8 and the left side panel 4 of the housing 2. When the outdoor unit 1-1 is viewed from above, for example, the heat exchanger 22 has an L-shape extending from the left side panel 4 toward the back panel 8. The heat exchanger 22 includes a plurality of heat dissipating fins (not shown) arranged apart from one another, and the plurality of pipes (not shown) provided to pass through the plurality of heat dissipating fins and allowing the refrigerant to flow through the pipes.

The electric component box 15 is provided above the compressor chamber 12. The electric component box 15 is provided in a space formed between an upper end of the partition board 10 and the top panel 7. The electric component box 15 is for controlling components of the air conditioner, and is arranged over the blower chamber 11 and the compressor chamber 12.

The electric component box 15 houses the control substrate 16 on which an electric component 17 is provided. The control substrate 16 includes a first substrate surface 16*a* and a second substrate surface 16*b* that is on the opposite side of the first substrate surface 16*a*. The first substrate surface 16*a* is a substrate surface on the side of the top panel 7. The second substrate surface 16*b* is a substrate surface on the side of the bottom panel 6. The control substrate 16 is a plate-shaped member with the first substrate surface 16*a* being parallel to the top panel 7. The electric component 17 is provided on the first substrate surface 16*a* of the control substrate 16. The electric component 17 is, for example, a semiconductor element, a reactor, or the like forming an inverter circuit that converts direct current power into alternating current power and drives at least one of the compressor 14 and the blower 13. The electric component 17 is not limited to the semiconductor element or the reactor constituting the inverter circuit and may be, for example, a semiconductor element constituting a converter circuit that converts alternating current power supplied from a commercial power source into direct current power and outputs it to an inverter circuit, a resistor for voltage detection, or a smoothing capacitor.

The heat dissipator 18-1 is in contact with the electric component 17. The heat dissipator 18-1 is a component for cooling the electric component 17. The heat dissipator 18-1 may be fixed to the electric component 17, or may be fixed to the control substrate 16 or the electric component box 15 via a fixing member (not shown). In the blower chamber 11, as illustrated in FIGS. 2 and 3, for example, the heat dissipator 18-1 is arranged outside the region that is obtained by projecting the inner edge of the bell mouth 9 in the direction of the back panel 8 from the front panel 3 of the housing 2, and is inside a region that is obtained by projecting the electric component box 15 in the direction of the top panel 7 from the bottom panel 6.

Note that the heat dissipator 18-1 need only be arranged such that at least a part of the heat dissipator 18-1 lies in a first region R1 between the electric component box 15 and the top panel 7.

Figure 4:
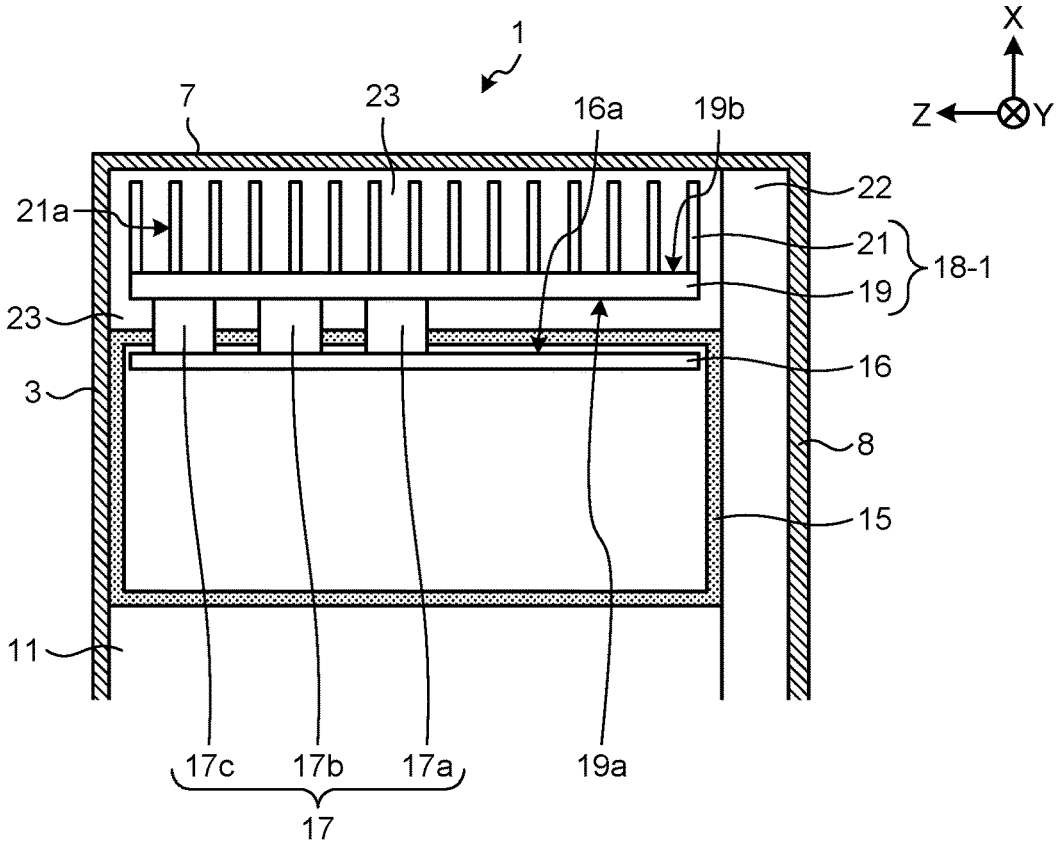
FIG. 4 is an enlarged view of a heat dissipator illustrated in FIGS. 2 and 3.

Next, a configuration of the heat dissipator 18-1 will be described with reference to FIG. 4. FIG. 4 is an enlarged view of the heat dissipator illustrated in FIGS. 2 and 3. In the following, a side of the heat dissipator 18-1 corresponding to the right side panel 5 will be referred to as a windward side, and a side of the heat dissipator 18-1 corresponding to the left side panel 4 will be referred to as a leeward side. FIG. 4 illustrates a state in which the heat dissipator 18-1, a plurality of the electric components 17 thermally connected to the heat dissipator 18-1, and the like are viewed from the side of the right side panel 5. The plurality of electric components 17 includes, for example, a first electric component 17*a*, a second electric component 17*b*, and a third electric component 17*c*. As illustrated in FIG. 4, the heat dissipator 18-1 includes a base 19 and a plurality of fins 21 provided on the base 19. The base 19 is a rectangular plate-shaped member with the width in the Z axis direction wider than the width in the Y axis direction. Note that the shape of the base 19 is not limited to the rectangle as long as the base 19 can transfer heat, which is transferred from the plurality of electric components 17 to the base 19, to the plurality of fins 21.

A lower surface 19*a* of the base 19 is in contact with the plurality of electric components 17. The plurality of fins 21 is provided on an upper surface 19*b* of the base 19. Each of the plurality of fins 21 is a plate-shaped member extending in the direction toward the top panel 7 of the housing 2 from the upper surface 19*b* of the base 19. The plurality of fins 21 is arranged apart from one another in the Z axis direction. Each of the plurality of fins 21 includes a heat dissipating surface 21*a*. The heat dissipating surface 21*a* is a surface facing the adjacent one of the fins 21. The heat dissipating surface 21*a* has a rectangular shape, for example. Note that the shape of the fin 21 is not limited to the rectangle as long as the fin 21 can dissipate the heat, which is transferred from the base 19 to the fin 21, to the air. The heat dissipating surface 21*a* is parallel to the front panel 3. An air passage 23 through which air passes is formed in a gap between the heat dissipating surfaces 21*a* of the fins 21 adjacent to each other.

As illustrated in FIG. 3, end surfaces on one end of the plurality of fins 21 in the Y axis direction form a windward end surface 21*c*. The windward end surface 21*c* corresponds to a windward end surface of the heat dissipator 18-1. Also, end surfaces on another end of the plurality of fins 21 in the Y axis direction form a leeward end surface 21*d*. The leeward end surface 21*d* corresponds to a leeward end surface of the heat dissipator 18-1.

Next, the flow of air in the heat dissipator 18-1 will be described. When the blower 13 rotates, the airflow AF is generated in the housing 2, and the air outside the housing 2 is taken into the blower chamber 11 of the housing 2 through the inlets 4*a* and 8*a*. The air taken into a second region R2 in the housing 2 through the inlet 8*a* flows into the air passages 23 of the heat dissipator 18-1 from the side of the windward end surface 21*c* of the fins 21. The second region R2 is a space within the first region R1 described above, is surrounded by the heat dissipator 18-1, the right side panel 5, the electric component box 15, the top panel 7, the front panel 3, and the back panel 8, and is also a region on the windward side of the heat dissipator 18-1. The air having flowed into the air passages 23 of the heat dissipator 18-1 in such a manner exchanges heat with the fins 21, flows out to the side of the leeward end surface 21*d* of the fins 21 thereafter, and is discharged to the outside of the housing 2 through the outlet 31 illustrated in FIG. 1.

According to the outdoor unit 1-1 of the first embodiment, the second region R2 surrounded by the heat dissipator 18-1, the right side panel 5, the back panel 8, the front panel 3, the electric component box 15, and the top panel 7 is formed on the windward side of the heat dissipator 18-1, so that there is no structure in the second region R2. Accordingly, even when the pressure in the closed space described above is high, the outdoor unit 1-1 according to the first embodiment can effectively use the air flowing in the second region R2 and reduce or prevent a reduction in the amount of heat exchange in the heat dissipator 18-1 without being affected by the pressure in the closed space. Therefore, the cooling capacity of the heat dissipator 18-1 can be improved as compared to the case where the plurality of fins is arranged in the Z axis direction with a part of each of the plurality of fins lying in the aforementioned closed space, as in the heat dissipator disclosed in Patent Literature 1.

Moreover, according to the outdoor unit 1-1 of the first embodiment, the cooling efficiency of the heat dissipator 18-1 is improved so that the electric component 17 provided on the control substrate 16 is efficiently cooled. The efficient cooling of the electric component 17 can extend the life of the control substrate 16 and the electric component 17. The outdoor unit 1-1 according to the first embodiment can also extend the life of another component not in contact with the heat dissipator 18-1. For example, in a case where the other component is an electrolytic capacitor, the electrolytic capacitor is a component that is easily affected by the ambient temperature because it contains an electrolyte solution. Being affected by the ambient temperature, the life of the electrolytic capacitor is roughly doubled when the ambient temperature drops by 10° C. The efficient cooling of the electric component 17 can prevent or reduce an increase in the ambient temperature as well. Preventing or reducing the increase in the ambient temperature can prevent or reduce the influence of heat on the other component not in contact with the heat dissipator 18-1, and can significantly extend the life thereof.

When the electric component 17 is downsized, the heat dissipation area of the electric component 17 is reduced, and the heat dissipation efficiency thereof is decreased. According to the outdoor unit 1-1 of the first embodiment, the electric component 17 is in contact with the heat dissipator 18-1 whose cooling efficiency is improved, and thus the decrease in the heat dissipation efficiency of the electric component 17 itself can be compensated for. As a result, the downsizing can be achieved while reducing heat generation of the reactor and the semiconductor element provided as the electric components 17, for example.

Second Embodiment

Figure 5:
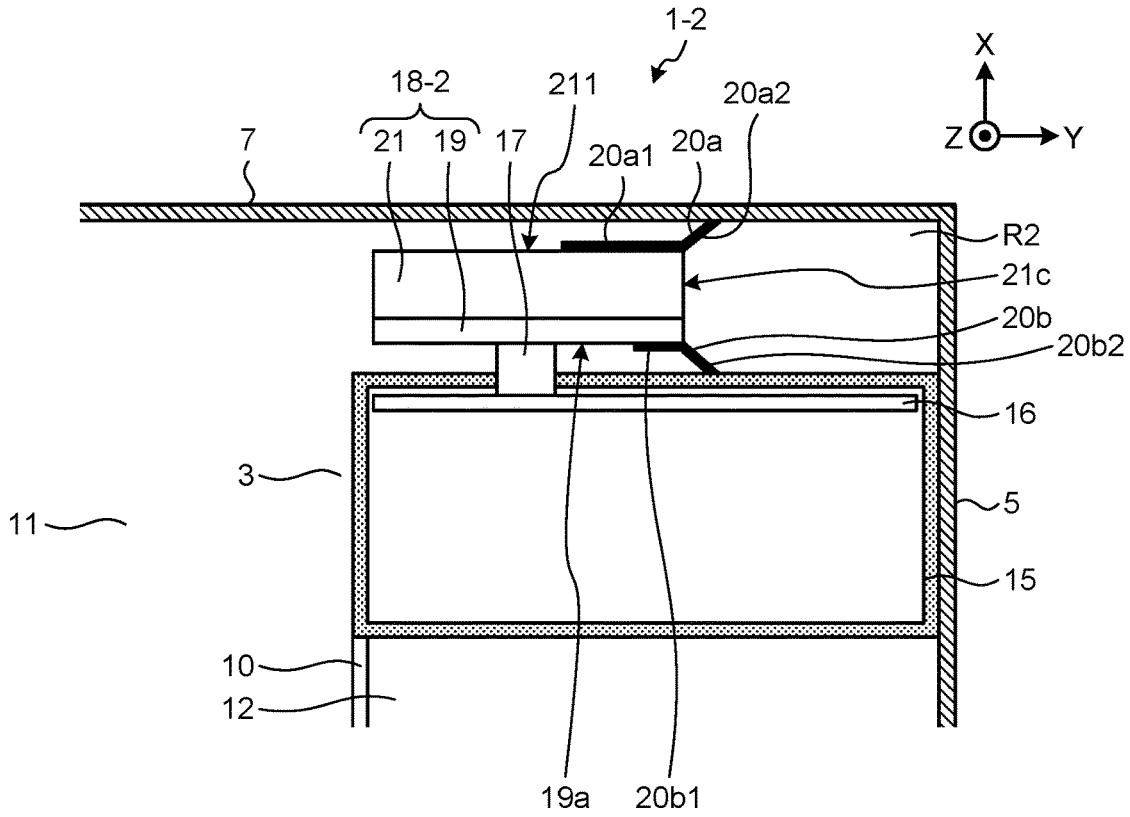
FIG. 5 is a diagram of a configuration of a heat dissipator included in an outdoor unit according to a second embodiment of the present invention.

FIG. 5 is a diagram of a configuration of a heat dissipator included in an outdoor unit according to a second embodiment of the present invention. An outdoor unit 1-2 according to the second embodiment includes a heat dissipator 18-2 instead of the heat dissipator 18-1. The heat dissipator 18-2 includes a deflector plate 20*a* and a deflector plate 20*b* in addition to the base 19 and the fins 21.

The deflector plate 20*a* is provided in a space between an end surface 211 of the fins 21 and the top panel 7. The deflector plate 20*a* may be fixed to the end surface 211 of the fins 21, or may be fixed to the inner surface of the top panel 7. The deflector plate 20*a* includes a flat surface portion 20*a*1 of a plate shape facing and parallel to the end surface 211 of the fins 21, and an inclined portion 20*a*2 provided at an end of the flat surface portion 20*a*1 on the windward side. The end of the flat surface portion 20*a*1 on the windward side coincides with an end of the flat surface portion 20*a*1 on the side of the second region R2. The flat surface portion 20*a*1 and the inclined portion 20*a*2 may be integrally manufactured using an insulating resin, a metal material, or the like, or may be individually manufactured and joined.

The inclined portion 20*a*2 functions as a first guide piece that guides the airflow AF generated in the second region R2 to the windward end surface 21*c* of the fins 21. The inclined portion 20*a*2 is a surface that is inclined at a certain angle toward the top panel 7 with respect to the Y axis direction. The certain angle is an arbitrary angle from 1° to 89°, for example. A tip of the inclined portion 20*a*2 may be in contact with the inner surface of the top panel 7, or may be provided at a position slightly away from the inner surface of the top panel 7.

The deflector plate 20*b* is provided in a space between the lower surface 19*a* of the base 19 and an upper surface of the electric component box 15. The deflector plate 20*b* may be fixed to a lower surface 19*a* of the base 19 or may be fixed to the upper surface of the electric component box 15. The deflector plate 20*b* includes a flat surface portion 20*b*1 of a plate shape facing and parallel to the lower surface 19*a* of the base 19, and the inclined portion 20*b*2 provided at an end of the flat surface portion 20*b*1 on the windward side. The end of the flat surface portion 20*b*1 on the windward side coincides with an end of the flat surface portion 20*b*1 on the side of the second region R2. The flat surface portion 20*b*1 and an inclined portion 20*b*2 may be integrally manufactured using an insulating resin, a metal material, or the like, or may be individually manufactured and joined.

The inclined portion 20*b*2 functions as a second guide piece that guides the airflow AF generated in the second region R2 to the windward end surface 21*c* of the fins 21. The inclined portion 20*b*2 is a surface that is inclined at a certain angle toward the electric component box 15 with respect to the Y axis direction. The certain angle is an arbitrary angle from 1° to 89°, for example. A tip of the inclined portion 20*b*2 may be in contact with the upper surface of the electric component box 15, or may be provided at a position slightly away from the upper surface of the electric component box 15.

According to the heat dissipator 18-2 illustrated in FIG. 5, the deflector plate 20*a* is provided on the windward side of the heat dissipator 18-2, and thus the air that is to flow into the space between the fins 21 and the top panel 7 from the windward side of the heat dissipator 18-2 is taken into the heat dissipator 18-2. Also, the deflector plate 20*b* is provided on the windward side of the heat dissipator 18-2, and thus the air that is to flow into the space between the base 19 and the electric component box 15 from the windward side of the heat dissipator 18-2 is taken into the heat dissipator 18-2. As a result, the amount of air taken into the heat dissipator 18-2 increases as compared to a case where the deflector plates 20*a* and 20*b* are not provided. Therefore, in the heat dissipator 18-2, the velocity of flow of the air flowing through the heat dissipator 18-2 is faster than that flowing through the heat dissipator 18-1 illustrated in FIG. 3, and the cooling efficiency of the electric component 17 in contact with the heat dissipator 18-2 is further improved.

Note that the heat dissipator 18-2 illustrated in FIG. 5 need only be provided with at least one of the deflector plate 20*a* and the deflector plate 20*b*, and even when the heat dissipator 18-2 is provided with only the deflector plate 20*a*, for example, the cooling efficiency of the electric component 17 can be improved compared to the heat dissipator 18-1 illustrated in FIG. 3.

Third Embodiment

Figure 6:
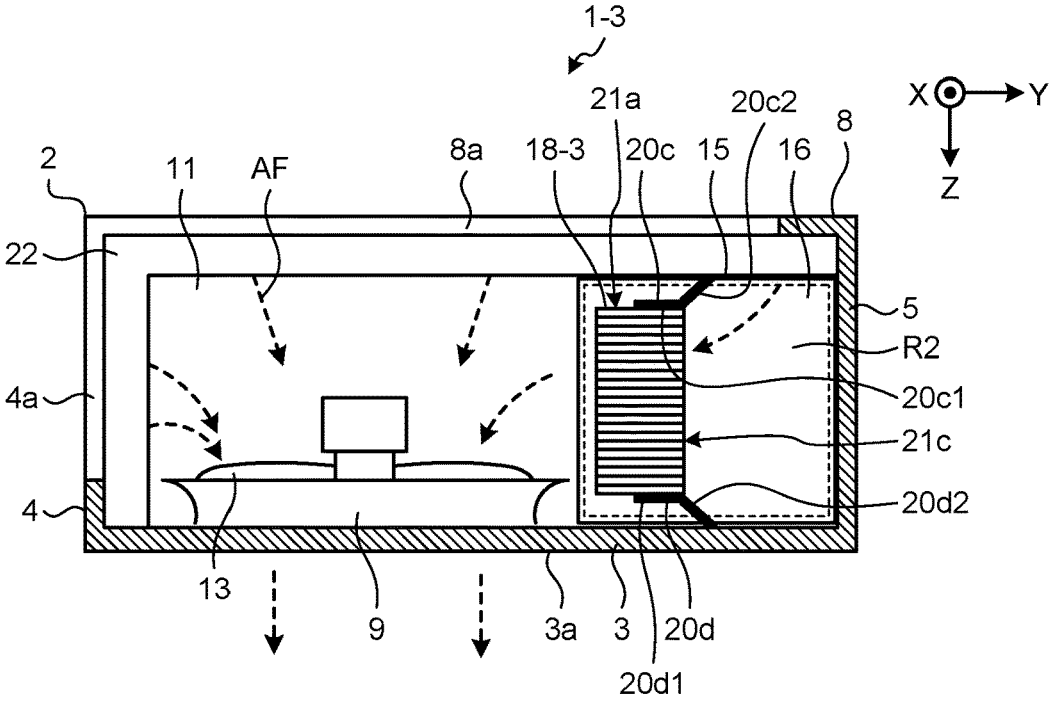
FIG. 6 is a diagram of a configuration of a heat dissipator included in an outdoor unit according to a third embodiment of the present invention.

FIG. 6 is a diagram of a configuration of a heat dissipator included in an outdoor unit according to a third embodiment of the present invention. An outdoor unit 1-3 according to the third embodiment includes a heat dissipator 18-3 instead of the heat dissipator 18-1. The heat dissipator 18-3 includes a deflector plate 20*c* and a deflector plate 20*d* in addition to the base 19 and the fins 21.

The deflector plate 20*c* is provided in a space between the fins 21 and the back panel 8. The deflector plate 20*c* may be fixed to the fin 21, or may be fixed to the inner surface of the back panel 8. The deflector plate 20*c* includes a flat surface portion 20*c*1 of a plate shape facing and parallel to the heat dissipating surfaces 21*a* of the fins 21, and an inclined portion 20*c*2 provided at an end of the flat surface portion 20*c*1 on the windward side. The end of the flat surface portion 20*c*1 on the windward side coincides with an end of the flat surface portion 20*c*1 on the side of the second region R2. The flat surface portion 20*c*1 and the inclined portion 20*c*2 may be integrally manufactured using an insulating resin, a metal material, or the like, or may be individually manufactured and joined.

The inclined portion 20*c*2 functions as a third guide piece that guides the airflow AF generated in the second region R2 to the windward end surface 21*c* of the fins 21. The inclined portion 20*c*2 is a surface that is inclined at a certain angle toward the back panel 8 with respect to the Y axis direction. The certain angle is an arbitrary angle from 1° to 89°, for example. A tip of the inclined portion 20*c*2 may be in contact with the inner surface of the back panel 8, or may be provided at a position slightly away from the inner surface of the back panel 8.

The deflector plate 20*d* is provided in a space between the fins 21 and the front panel 3. The deflector plate 20*d* may be fixed to the fin 21, or may be fixed to the inner surface of the front panel 3. The deflector plate 20*d* includes a flat surface portion 20*d*1 of a plate shape facing and parallel to the heat dissipating surfaces 21*a* of the fins 21, and an inclined portion 20*d*2 provided at an end of the flat surface portion 20*d*1 on the windward side. The end of the flat surface portion 20*d*1 on the windward side coincides with an end of the flat surface portion 20*d*1 on the side of the second region R2. The flat surface portion 20*d*1 and the inclined portion 20*d*2 may be integrally manufactured using an insulating resin, a metal material, or the like, or may be individually manufactured and joined.

The inclined portion 20*d*2 functions as a fourth guide piece that guides the airflow AF generated in the second region R2 to the windward end surface 21*c* of the fins 21. The inclined portion 20*d*2 is a surface that is inclined at a certain angle toward the front panel 3 with respect to the Y axis direction. The certain angle is an arbitrary angle from 1° to 89°, for example. A tip of the inclined portion 20*d*2 may be in contact with the inner surface of the front panel 3, or may be provided at a position slightly away from the inner surface of the front panel 3.

According to the heat dissipator 18-3 illustrated in FIG. 6, the deflector plate 20*c* is provided on the windward side of the heat dissipator 18-3, and thus the air that is to flow into the space between the fins 21 and the back panel 8 from the windward side of the heat dissipator 18-3 is taken into the heat dissipator 18-3. Also, the deflector plate 20*d* is provided on the windward side of the heat dissipator 18-3, and thus the air that is to flow into the space between the fins 21 and the front panel 3 from the windward side of the heat dissipator 18-3 is taken into the heat dissipator 18-3. As a result, the amount of air taken into the heat dissipator 18-3 increases as compared to a case where the deflector plates 20*c* and 20*d* are not provided. Therefore, in the heat dissipator 18-3, the velocity of flow of the air flowing through the heat dissipator 18-3 is faster than that flowing through the heat dissipator 18-1 illustrated in FIG. 3, and the cooling efficiency of the electric component 17 in contact with the heat dissipator 18-3 is further improved.

Note that the heat dissipator 18-3 illustrated in FIG. 6 need only be provided with at least one of the deflector plate 20*c* and the deflector plate 20*d*, and even when the heat dissipator 18-3 is provided with only the deflector plate 20*d*, for example, the cooling efficiency of the electric component 17 can be improved compared to the heat dissipator 18-1 illustrated in FIG. 3. Moreover, at least one of the deflector plate 20*c* and the deflector plate 20*d* illustrated in FIG. 6 may be combined with the heat dissipator 18-2 illustrated in FIG. 5.

Fourth Embodiment

Figure 7:
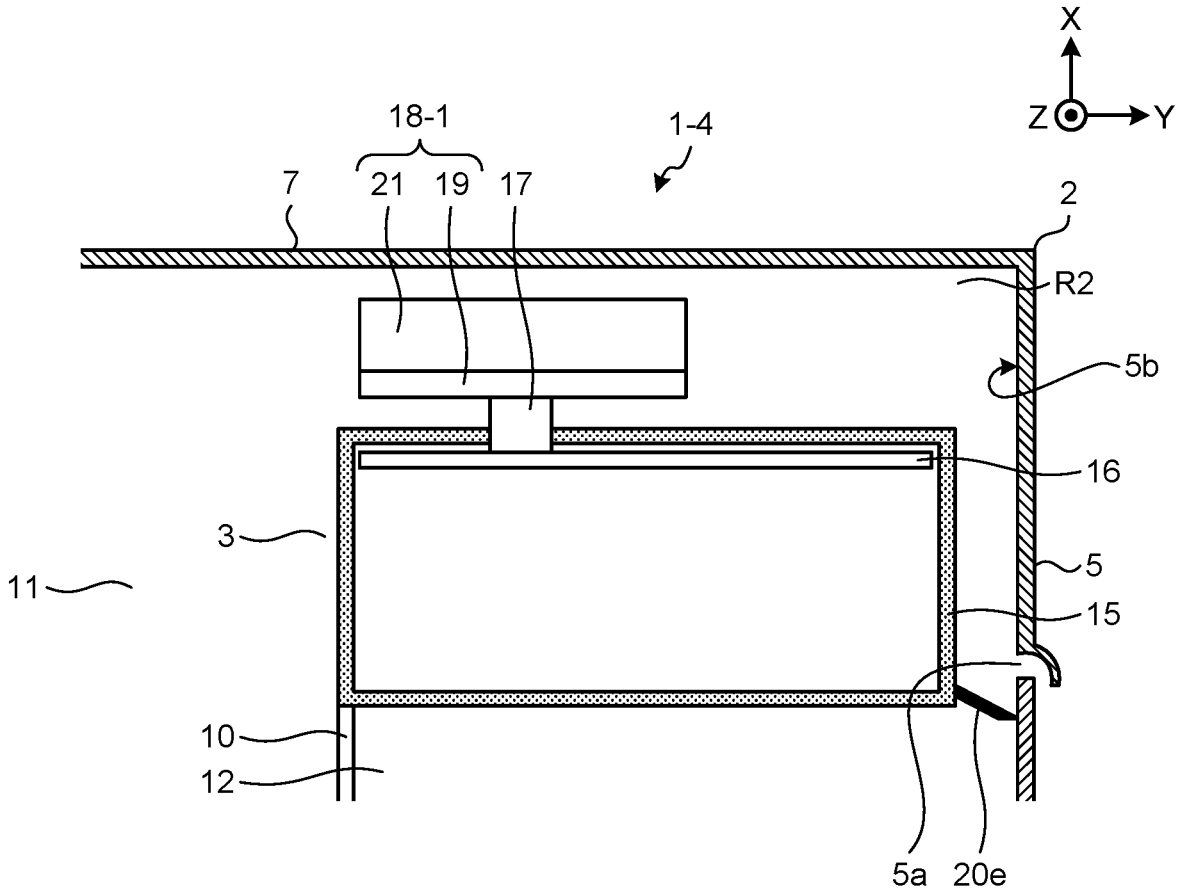
FIG. 7 is a diagram of a configuration of an outdoor unit according to a fourth embodiment of the present invention.

FIG. 7 is a diagram of a configuration of an outdoor unit according to a fourth embodiment of the present invention. In an outdoor unit 1-4 according to the fourth embodiment, an inlet 5*a* is formed on the right side panel 5, and a deflector plate 20*e* is provided between the electric component box 15 and the right side panel 5. The inlet 5*a* is provided above the position of the deflector plate 20*e* in the X axis direction. Also, as rain may enter from the inlet 5*a*, the inlet 5*a* is desirably provided below the position of the upper surface of the electric component box 15 in the X axis direction. As a result, the electric component 17 is less easily hit by the rain entering from the inlet 5*a*. The inlet 5*a* formed in such a manner communicates with the second region R2.

The deflector plate 20*e* extends from the electric component box 15 toward the inner surface of the right side panel 5, and also extends from the front panel 3 illustrated in FIG. 2 to the heat exchanger 22 provided inside the back panel 8.

In the outdoor unit 1-4, the air taken in from the inlet 5*a* is taken into the second region R2 in the housing 2 without passing through the heat exchanger 22 illustrated in FIG. 3, and is used for cooling of the heat dissipator 18-1. For example, when an air conditioner equipped with the outdoor unit 1-4 is in cooling operation, the temperature of the refrigerant flowing through the heat exchanger 22 is higher than the outside air temperature, so that the air taken in from the inlet 8*a* of the back panel 8 is increased in temperature by exchanging heat with the heat exchanger 22 and becomes warmer than the outside temperature. Therefore, the heat dissipator 18-1 may not be able to be cooled effectively when the air having passed through the heat exchanger 22 is used. In the outdoor unit 1-4 according to the fourth embodiment, the air taken in from the inlet 5*a* does not pass through the heat exchanger 22, whereby the cooling capacity of the heat dissipator 18-1 can be further improved compared to the outdoor unit 1-1 according to the first embodiment.

Fifth Embodiment

Figure 8:
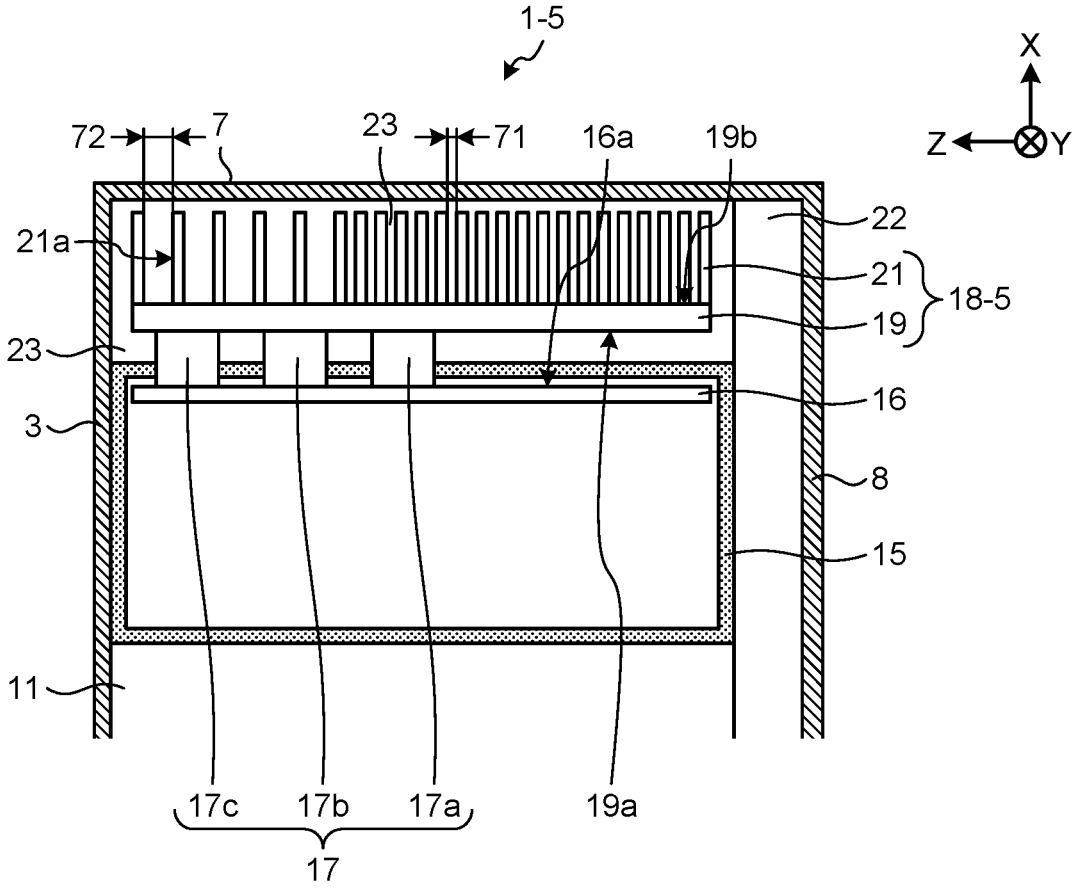
FIG. 8 is a diagram of a configuration of an outdoor unit according to a fifth embodiment of the present invention.

FIG. 8 is a diagram of a configuration of an outdoor unit according to a fifth embodiment of the present invention. An outdoor unit 1-5 according to the fifth embodiment includes a heat dissipator 18-5 instead of the heat dissipator 18-1. In the outdoor units 1-5, for example, the first electric component 17*a* that generates the highest amount of heat and the second electric component 17*b* and the third electric component 17*c* each generate a lower amount of heat than the first electric component 17*a* are arranged in the order of the first electric component 17*a*, the second electric component 17*b*, and the third electric component 17*c* from the back panel 8 toward the front panel 3. The heat dissipator 18-5 is then formed such that a first fin pitch 71 of the plurality of fins 21 provided corresponding to the first electric component 17*a* is narrower than a second fin pitch 72 of the plurality of fins 21 provided corresponding to the second electric component 17*b* and the third electric component 17*c*.

When the first electric component 17*a* is a semiconductor element formed by a wide bandgap semiconductor, the wide bandgap semiconductor has higher heat resistance performance and higher switching speed than a silicon semiconductor. Therefore, the reactor, the motor, and the like can be downsized by operating the first electric component 17*a* at a high frequency. However, the heat generated by the wide bandgap semiconductor may have a higher value than the heat generated by the silicon semiconductor depending on the frequency, so that the first electric component 17*a* needs to be sufficiently cooled.

Also, when the reactor is downsized, the reactor can be provided on the control substrate 16. When the reactor is thus provided on the control substrate 16, it is necessary to reduce the influence of the heat generated by the reactor on a component existing around the reactor, and to prevent solder used for connecting a reactor terminal to the control substrate 16 from melting due to the heat generated by the reactor. Therefore, when the reactor is provided on the control substrate 16, it is necessary to sufficiently cool the reactor and to prevent or reduce an increase in the temperature of the reactor as compared to a case where the reactor is installed in a place other than the control substrate 16.

According to the heat dissipator 18-5 illustrated in FIG. 8, the first fin pitch 71 is narrower than the second fin pitch 72 so that the heat dissipation area of the fins 21 provided in correspondence with the first electric component 17*a* is increased, and that the cooling efficiency of the heat dissipator 18-5 can be improved. As a result, the life of the first electric component 17*a* can be extended. Moreover, the amount of material used to form the fins 21 is reduced as compared to a case where all the fins 21 are arranged at the first fin pitch 71, whereby the cost of manufacturing the heat dissipator 18-5 can be reduced.

Also, in a case where an electrolytic capacitor is provided as a component not in contact with the heat dissipator 18-5, as described above, the life of the electrolytic capacitor is roughly doubled when the ambient temperature drops by 10° C. Even when such a component easily affected by the ambient temperature is used, the heat dissipator 18-5 illustrated in FIG. 8 can significantly extend the life of the component not in contact with the heat dissipator 18-5.

Moreover, because the plurality of electric components 17 is arranged apart from one another in the Z axis direction as illustrated in FIG. 8, compared to a case where the plurality of electric components 17 is arranged in the Y axis direction, the heat generated by the plurality of electric components 17 is likely to be distributed to the plurality of fins 21 so that the plurality of electric components 17 can be effectively cooled.

Moreover, the plurality of electric components 17 is arranged in the Z axis direction so that, as compared to a case where the plurality of electric components 17 is arranged in the Y axis direction, the heat generated by the first electric component 17*a* is less easily transferred to the second electric component 17*b* with a lower allowable temperature than the first electric component 17*a* even when the first electric component 17*a* has the highest amount of heat generated, and that it is possible to prevent the second electric component 17*b* from getting hot and failing.

Moreover, when the first electric component 17*a*, the second electric component 17*b*, and the third electric component 17*c* are arranged in the order of the first electric component 17*a*, the second electric component 17*b*, and the third electric component 17*c* from the windward side to the leeward side, the heat generated by the first electric component 17*a* and the second electric component 17*b* causes the temperature of a specific one of the plurality of fins 21 to be higher than the temperature of the rest of the fins 21. Therefore, the heat generated by the third electric component 17*c* on the leeward side is less easily absorbed by the fin. On the other hand, when the first electric component 17*a*, the second electric component 17*b*, and the third electric component 17*c* are arranged in the Z axis direction as illustrated in FIG. 8, the heat generated by the third electric component 17*c* is absorbed by the fin 21 corresponding to the third electric component 17*c* without being affected by the heat generated in the first electric component 17*a* and the second electric component 17*b*. Therefore, the third electric component 17*c* can be effectively cooled.

Note that the heat dissipator 18-5 illustrated in FIG. 8 may be combined with at least one of the deflector plate 20*a* and the deflector plate 20*b* illustrated in FIG. 5, or may be combined with at least one of the deflector plate 20*c* and the deflector plate 20*d* illustrated in FIG. 6.

Moreover, the outdoor units 1-1 to 1-5 of the first to fifth embodiments can each be used as an outdoor unit of a device other than the air conditioner such as a heat pump water heater.

Furthermore, in the first embodiment, the outdoor unit 1-1 when viewed from the front is provided with the blower chamber 11 on the left side and the compressor chamber 12 on the right side, but the outdoor unit 1-1 may be provided with the compressor chamber 12 on the left side and the blower chamber 11 on the right side. In this case, the second region R2 described above is a region surrounded by the heat dissipator 18-1, the left side panel 4, the back panel 8, the front panel 3, the electric component box 15, and the top panel 7. The similar applies to the outdoor units 1-2 to 1-5 according to the second to fifth embodiments. Moreover, when the compressor chamber 12 is provided on the left side and the blower chamber 11 is provided on the right side, the inlet 5*a* illustrated in FIG. 7 is formed on the left side panel 4 of the housing 2 of the outdoor unit 1-4 according to the fourth embodiment.

Sixth Embodiment

Figure 9:
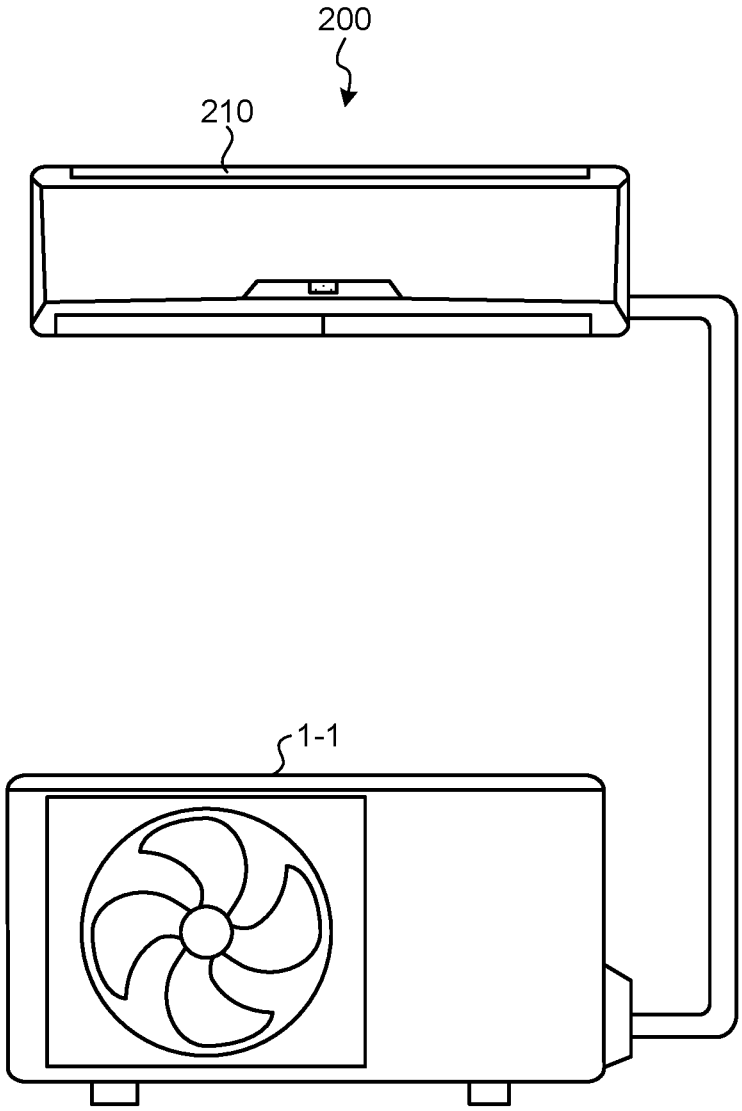
FIG. 9 is a diagram illustrating an example of a configuration of an air conditioner according to a sixth embodiment of the present invention.

FIG. 9 is a diagram illustrating an example of a configuration of an air conditioner according to a sixth embodiment of the present invention. An air conditioner 200 includes the outdoor unit 1-1 according to the first embodiment and an indoor unit 210 connected to the outdoor unit 1-1. The use of the outdoor unit 1-1 according to the first embodiment can provide the air conditioner 200 in which the housing 2 can be downsized while improving the cooling efficiency of the heat dissipator 18-1 illustrated in FIG. 2 and the like. Moreover, with the improved cooling efficiency of the heat dissipator 18-1, the air conditioner 200 having high reliability can be provided. Note that instead of the outdoor unit 1-1 according to the first embodiment, the air conditioner 200 may be combined with the outdoor unit 1-2 according to the second embodiment, the outdoor unit 1-3 according to the third embodiment, the outdoor unit 1-4 according to the fourth embodiment, or the outdoor unit 1-5 according to the fifth embodiment.

The configuration illustrated in the above embodiment merely illustrates an example of the content of the present invention, and can thus be combined with another known technique or partially omitted and/or modified without departing from the scope of the present invention.

The invention claimed is:

1. An outdoor unit comprising:

a housing that includes a front panel having an outlet for an airflow, a back panel facing the front panel, a left side panel, a right side panel facing the left side panel, a bottom panel, and a top panel facing the bottom panel;

a control substrate that is provided in the housing and provided with a first electric component and a second electric component that generates a lower amount of heat than the first electric component;

an electric component box in which the control substrate is provided; and a heat dissipator that is a component including a plurality of fins and is provided between the top panel and the electric component box and dissipates heat generated by the first electric component and the second electric component, wherein a region around which the heat dissipator, the back panel, the front panel, the electric component box, and the top panel are present is formed on a windward side of the heat dissipator, the heat dissipator includes a base, a surface of which is in contact with the first electric component and the second electric component, and the plurality of fins that is arranged side by side on a surface opposite to the surface in contact with the first electric component and the second electric component, and a gap between some of the plurality of the fins which are provided on an opposite side of the first electric component across the base is narrower than a gap between some of the plurality of the fins which are provided on an opposite side of the second electric component across the base.

2. The outdoor unit according to claim 1, further comprising a first guide piece that is provided between the heat dissipator and the top panel so as to guide an airflow generated in the region to a windward end surface of the heat dissipator.

3. The outdoor unit according to claim 1, further comprising a second guide piece that is provided between the heat dissipator and the electric component box so as to guide the airflow generated in the region to the windward end surface of the heat dissipator.

4. The outdoor unit according to claim 1, further comprising a third guide piece that is provided between the heat dissipator and the back panel so as to guide the airflow generated in the region to the windward end surface of the heat dissipator.

5. The outdoor unit according to claim 1, further comprising a fourth guide piece that is provided between the heat dissipator and the front panel so as to guide the airflow generated in the region to the windward end surface of the heat dissipator.

6. The outdoor unit according to claim 1, wherein an inlet communicating with the region is formed on the right side panel or the left side panel.

7. The outdoor unit according to claim 1, wherein the first electric component is a semiconductor element including a wide bandgap semiconductor.

8. An air conditioner comprising the outdoor unit according to claim 1, and an indoor unit.

* * * * *